United States Patent [19]

Waldau

[11] 4,442,825

[45] Apr. 17, 1984

[54] FUEL FEEDER DEVICE FOR SPACE HEATING STOVES

[76] Inventor: Geoffrey Waldau, 1570 Mt. Eagle Pl., Alexandria, Va. 22302

[21] Appl. No.: 330,177

[22] Filed: Dec. 14, 1981

Related U.S. Application Data

[63] Continuation of Ser. No. 114,121, Jan. 21, 1980, abandoned.

[51] Int. Cl.[3] ..... F24B 7/00; F24B 13/04

[52] U.S. Cl. ..... 126/68; 126/73; 126/223; 110/101 CC; 110/101 CD

[58] Field of Search ..... 126/68, 10, 73, 74, 126/165, 152 B, 166, 283, 223, 225, 224, 124, 107, 7, 11; 110/101 CA, 101 CD, 101 CC, 101 CF, 175 A

[56] References Cited

U.S. PATENT DOCUMENTS

| | | | |
|---|---|---|---|
| 105,746 | 7/1870 | Warren . | |
| 116,058 | 6/1871 | Hoxworth et al. . | |
| 133,937 | 12/1872 | Hatch . | |
| 158,653 | 1/1875 | Treadwell . | |
| 179,776 | 7/1876 | Eickemeyer . | |
| 186,286 | 1/1877 | Wood | 126/223 |
| 217,651 | 7/1879 | Stocum | 126/223 |
| 494,809 | 4/1893 | Hilton . | |
| 659,971 | 10/1900 | Hower . | |
| 742,198 | 10/1903 | Josten | 126/73 |
| 875,371 | 12/1907 | Ormsby . | |
| 990,053 | 4/1911 | Leitenberger . | |
| 1,144,156 | 6/1915 | Stordahl | 126/73 |
| 1,152,732 | 9/1915 | Hill | 126/73 |
| 1,335,265 | 3/1920 | Zamernik | 110/101 CC |
| 1,713,508 | 5/1929 | Andre | 110/101 CC |
| 1,970,383 | 8/1934 | Lauterbur et al. . | |
| 2,229,555 | 1/1941 | Dartnell . | |
| 2,376,079 | 5/1945 | Orphan | 110/101 CD X |
| 2,572,674 | 10/1951 | Strange . | |
| 4,126,119 | 10/1978 | Fike . | |
| 4,185,567 | 1/1980 | Grossniklaus . | |

*Primary Examiner*—Larry Jones

*Attorney, Agent, or Firm*—Prutzman, Kalb, Chilton & Alix

[57] ABSTRACT

A detachable fuel feeder device for use with wood stoves is disclosed comprising an inclined fuel storage chamber adapted for alignment with the door opening of the wood stove, a dog clamp for detachably mounting the chamber to the wood stove, a door pivotally mounted to the storage chamber, a releasable catch selectively holding the door to close off the storage chamber, and a sensor to sense the amount of combusting wood fuel in the combustion chamber of the wood stove and being operationally connected to the catch to actuate the catch upon sensing a predetermined amount of combusting wood fuel. Alternative sensors are disclosed for sensing the height of combusting fuel, the weight of combusting fuel and a predetermined amount of heat.

An alternate embodiment discloses a generally horizontal fuel storage chamber having a spring-loaded pusher element for injecting wood fuel into the combustion chamber.

34 Claims, 5 Drawing Figures

10
12
14
16
18
20
22
24
26
28
30
32
34
36
38
40
42
44
46
48
50
52
54
56
58
60
62
64
66
68
70
71
72
74
76
78
80
82
84
86
88
90
94

10
12
16
18
20
22
24
28
30
32
34
36
38
40
42
44
46
48
56
58
60
62
64
66
68
70
71
72
74
76
78
80
82
84
86
88
94

FUEL FEEDER DEVICE FOR SPACE HEATING STOVES

This application is a continuation application of U.S. patent application Ser. No. 114,121 filed on Jan. 21, 1980 now abandoned.

BACKGROUND OF THE INVENTION

This invention relates to a fuel feeder device for space heating stoves and more particularly to an automatic fuel feeder device for detachable securement to a space heating stove such as a conventional wood stove.

Conventional wood stoves require manual refueling at intervals that are limited by the fuel capacity of the stove. Although the type of wood and the regulation of air intake also effect the length of time between refuelings, the fuel capacity of the stove limits the maximum period between refuelings by limiting the amount of wood that can be put into the stove. Thus, stoves that do not have a fuel capacity sufficient to burn throughout the night require stoking during the course of the night. Such maintenance can be inconvenient and disturbing to one's slumber. Also, the period of absence from the house is limited somewhat by the maximum period between refuelings inasmuch as heat from the stove may be required to maintain the house.

While a larger fuel capacity produces a longer interval between refuelings, the larger fuel capacity stove may be oversized for the particular heating application. Oversized stoves involve additional initial cost and are inefficient in operation and space utilization.

No prior devices are known to detachably secure to a conventional wood stove and automatically stoke the fire to extend the time period between manual stokings. Also, no such devices are known that are adaptable and detachable to a wide variety of existing wood stoves.

SUMMARY OF THE INVENTION

A fuel feeder device for wood-burning stoves is disclosed comprising a fuel storage chamber for storing a load of wood fuel, clamp elements to detachably secure the storage chamber to the door opening of a wood stove, a pivotally mounted door with an actuable releasable catch to hold the wood fuel in the storage chamber, a sensor to sense a predetermined amount of combusting wood fuel in the wood stove with the sensor operationally connected to the catch and actuating the catch upon sensing the predetermined amount of combusting wood fuel to release the wood fuel from the storage chamber. The storage chamber is inclined downwardly into the wood stove so that gravity will deliver the fuel into the wood stove upon release of the catch and door. Alternatively, the fuel storage chamber is positioned horizontally with respect to the stove door opening and a spring biased plunger injects the additional wood fuel into the stove upon release of the catch and door.

The sensor element is an elongated member extending into the wood stove firebox to lie atop the combusting fuel and sense the height of fuel remaining in the firebox. Alternatively, a heat sensor and a weight sensor are utilized for sensing the predetermined amount of combusting wood fuel remaining in the firebox.

It is a principal object of this invention to provide an automatic fuel feeder device for detachable securement to a wood-burning stove.

A further object of the invention is to provide a fuel feeder device that monitors the amount of fuel remaining in a wood-burning stove and automatically delivers additional fuel to the stove as required.

A still further object of the invention is to provide a fuel feeder device that detachably secures in air-tight relationship to a wood stove.

A still further object of the invention is to provide a fuel feeder device that monitors the amount of combusting wood fuel remaining in a wood stove by sensing the height of the remaining fuel.

A still further object of the invention is to provide a fuel feeder device that monitors the amount of combusting wood fuel remaining in a wood stove by sensing the weight of the combusting wood fuel.

A still further object of the invention is to provide a fuel feeder device that monitors the amount of combusting wood fuel remaining in a wood stove by sensing the amount of heat generated by the stove.

A still further object of the invention is to provide a fuel feeder device that efficiently enlarges the period between manual stokings of a wood stove.

A still furher object of the invention is to provide a fuel feeder device that allows quick and easy attachment and detachment to a conventional wood-burning stove.

A still further object of the invention is to provide a fuel feeder device for wood-burning stoves that detachably secures to a wood stove with the moving parts essentially contained within the stove to maintain air-tight integrity.

A still further object of the invention is to provide a fuel feeder device for wood stoves exhibiting a limited number of moving parts for reliable operation.

A still further object of the invention is to provide a fuel feeder device for woodburning stoves that is space efficient.

A still further object of the invention is to provide a fuel feeder device for wood-burning stoves that is economical to manufacture, durable in use, and refined in appearance.

DESCRIPTION OF THE PREFERRED EMBODIMENT

Figure 1:
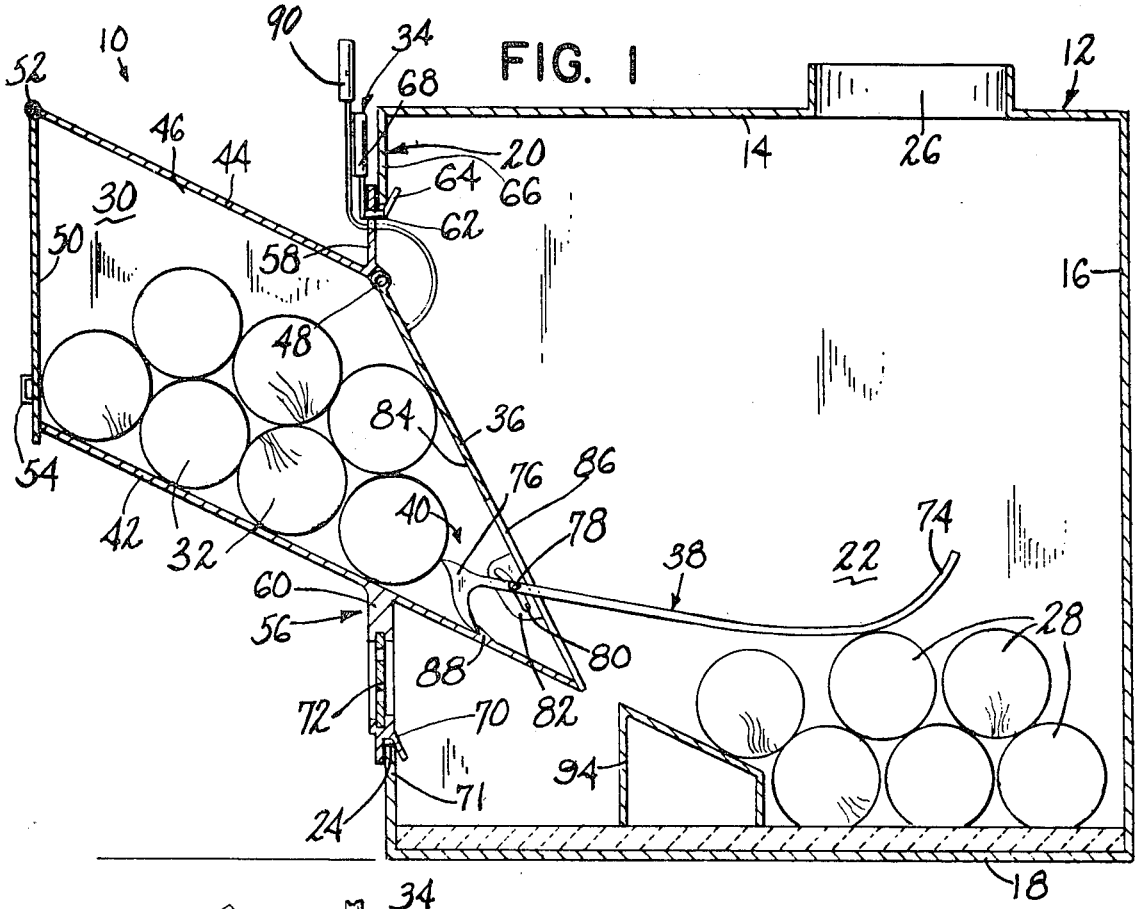
FIG. 1 is an elevated sectional side view of the invention mounted in a conventional wood stove.

The fuel feeder device of this invention is generally designated by the numeral 10 and is shown in FIG. 1 mounted to a conventional wood stove 12. Wood stove 12 is comprised of top wall 14, back wall 16, bottom wall 18 and front wall 20 enclosing combustion chamber 22. Fuel feeder 10 is shown mounted within door opening 24 of front wall 20 in FIG. 1. When fuel feeder 10 is detached from stove 12, door opening 24 allows access to combustion chamber 22 for manual stoking of the fire and can be closed by an air-tight door (not shown) in a conventional manner. Stack 26 extends through top wall 14 to connect combustion chamber 22 with the chimney flue (not shown). For purposes of explanation, combusting wood fuel pieces 28 are shown in combustion chamber 22.

Fuel feeder device 10 comprises a fuel storage chamber 30 to hold additional wood fuel pieces 32, mounting assembly 34 for detachably securing fuel feeder 10 in door opening 24, firebox door 36, sensor 38 and catch assembly 40 (FIG. 1).

Fuel storage chamber 30 has a lower wall 42, an upper wall 44, and opposing side walls 46. Door 36 is pivotally mounted to upper wall 44 by hinge element 48 at the exit or first end portion of storage chamber 30. Loading door 50 is pivotally mounted to upper wall 44 by hinge element 52 at the entrance or second end portion of storage chamber 30. Loading door 50 pivots about hinge element 52 to allow access to the interior of storage chamber 30 in order to load fuel into the feeder 10. Handle 54 on the outer surface of door 50 facilitates the movement of door 50.

Figure 2:
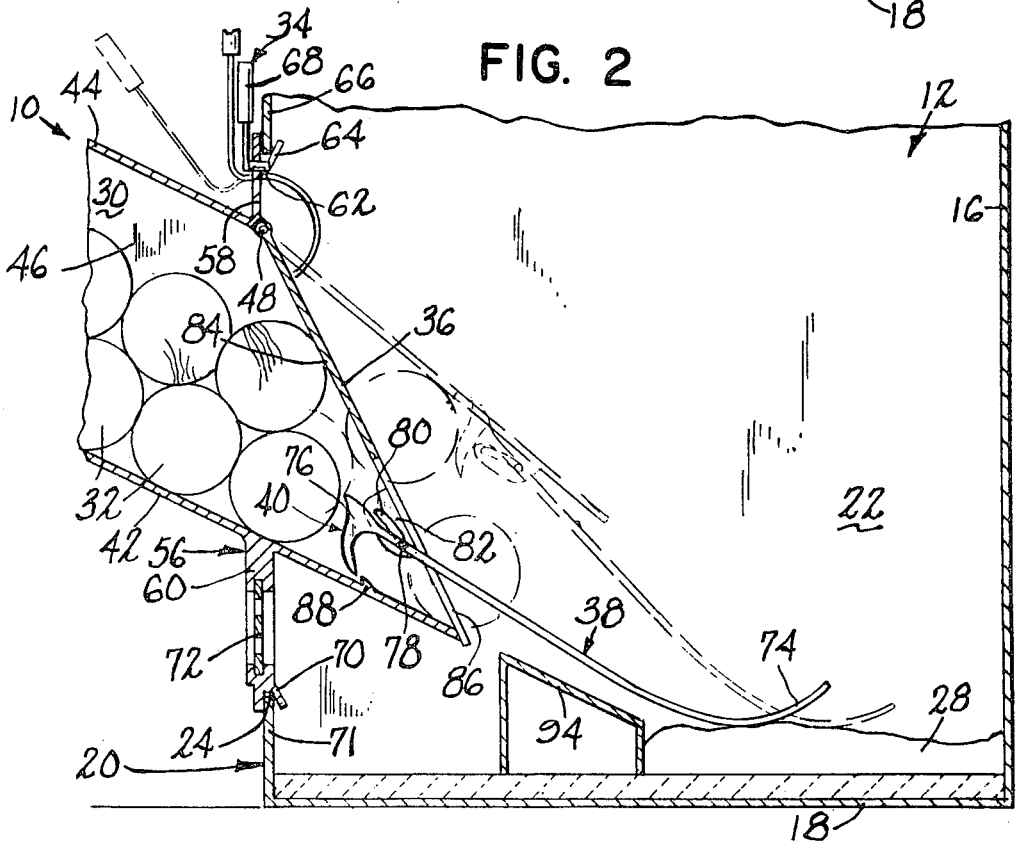
FIG. 2 is an elevated sectional side view similar to FIG. 1 and showing operational positions of the invention.

A frame or flange assembly 56 is rigidly secured to and extends about the outer periphery of storage chamber 30, and is shown in FIG. 1 as comprised of upper flange 58 securely attached to, or integral with, upper wall 44 and lower flange 60 securely attached to, or integral with, lower wall 42. Dog clamp 62 of mounting assembly 34 extends through upper flange 58 and is rotatably mounted thereto to allow rotation of handle 68 to rotate jam member 64 into locking engagement with upper portion 66 of front wall 20 as shown in FIGS. 1 and 2. Dog clamp 62 securely clamps upper flange 58 to the upper portion 66 of front wall 20. Other conventional means of detachable securement may be utilized.

The lower edge 70 of lower flange 60 is furcated to be supportively engaged by the lower portion 71 of front wall 20 when fuel feeder 10 is mounted in the position of FIGS. 1 and 2. A sliding valve 72 is contained within lower flange 60 to allow regulation of air flow into combustion chamber 22.

Sensor element 38 is an elongated rod having an arcuate first or inner end 74 and a hook element 76 attached to its second or outer end. A pair of opposing guide pins 78 extend laterally from sensor element 38 and are each slidably mounted in respective slots 80 of opposing spaced apart guides 82 attached to the inner surface 84 of door 36. Sensor element 38 extends through slot 86 of door 36 into combustion chamber 22 as shown in FIG. 1. Keeper element 88 is attached to lower wall 42 and releasably engages hook element 76. Catch assembly 40 generally comprises hook element 76 and keeper 88 and operates in conjunction with sensor 38 to releasably maintain door 36 in a closed position and hold additional wood pieces 32 in storage chamber 30 until actuation by sensor 38 as will be explained in detail subsequently.

In operation, fuel feeder 10 is secured to wood stove 12 by inserting fuel feeder 10 into door opening 24 such that lower portion 71 of front wall 20 supportively engages furcated edge 70 of lower flange 60. Lower portion 71 is supporting the weight of fuel feeder 10 and forms an air-tight engagement with furcated edge 70. Asbestos rope (not shown) can be utilized within furcated edge 70 to insure an air-tight seal. Handle 68 is then rotated to move jam member 64 into locking engagement with upper portion 66 of front wall 20. Upper portion 66 is thus securely sandwiched between upper flange 58 and jam member 64 to provide a generally air-tight attachment of fuel feeder 10 to wood stove 12. Asbestos rope (not shown) may be utilized between flange 58 and upper portion 66 to insure an air-tight seal.

Upon securement of fuel feeder device 10 to wood stove 12, handle 90 is utilized, if necessary, to abut door 36 against the inner end of lower wall 42 and thus engage hook element 76 into keeper 88. In this position, arcuate end 74 of sensor 38 is lying atop the combusting wood fuel 28 in combustion chamber 22 (FIG. 1). The arcuate shape of end 74 prevents sensor 30 from becoming caught in wood fuel pieces 28.

Loading door 50 is pivoted to allow access to storage chamber 30 and additional wood fuel pieces 32 are stacked within the chamber. Lower wall 42 is inclined downwardly to gravitationally force the additional fuel 32 against door 36. Upon loading storage chamber 30, door 50 is closed to provide an air-tight seal in chamber 30. As shown in FIG. 1, all of the moving parts are essentially contained within the air-tight storage chamber 30 and combustion chamber 22 to maintain the air-tight integrity of the stove. In this position, fuel feeder device 10 is operational to monitor the amount of combusting wood fuel 28 and automatically add additional fuel to combustion chamber 22 upon sensor 38 sensing a predetermined amount of combusting wood fuel by sensing the height thereof.

As wood fuel 28 burns and the height thereof decreases, inner end 74 of sensor 38 will move downwardly since it is lying atop the combusting wood fuel. During this downward movement of inner end 74, sensor element 38 is pivoting about the connection between hook element 76 and keeper 88 while guide pins 74 slide downwardly in slots 80. When pins 78 reach the lowermost points 92 of slots 80 in response to a further decrease in combustion fuel height, sensor element 38 will no longer pivot about the connection between hook element 76 and keeper 88, but rather upon further downward movement of end portion 74, it will pivot about guide pins 78 as they rest upon the lowermost points 92 of slots 80. Further downwardly movement of end 74 will cause pivotal movement about guide pins 78 resulting in hook element 76 disengaging from keeper 88 as shown in solid line in FIG. 2.

Upon the disengagement of hook element 76 from keeper 88, door 36 is released to freely pivot about hinge element 48. The downwardly inclined orientation of lower wall 42 causes the cylindrical shaped wood pieces 32 to tumble downwardly thereby opening door 36 and hence being delivered into combustion chamber 22 as shown in phantom line in FIG. 2. Chute element 94 positioned adjacent the first end portion or exit end of storage chamber 30 further directs delivery of the fuel to the combustion area. After all the wood has tumbled out of the storage chamber 30 into the combustion chamber 32, the weight of door 36 will cause it to pivot downwardly and slam closed with hook element 76 being engaged in keeper element 88.

Thus, sensor 38 monitors the amount of combusting fuel in chamber 22 by monitoring the height of remaining fuel. At a predetermined amount of combusting fuel, i.e., a predetermined height, the pivotal action of sensor element 38 about guide pins 78 result in disengagement of catch assembly 40 and the release of door 36 heretofore maintaining the additional wood fuel in storage chamber 30. Accordingly, an additional load of fuel has been automatically placed in the combustion chamber to extend the period between manual stokings.

Figure 3:
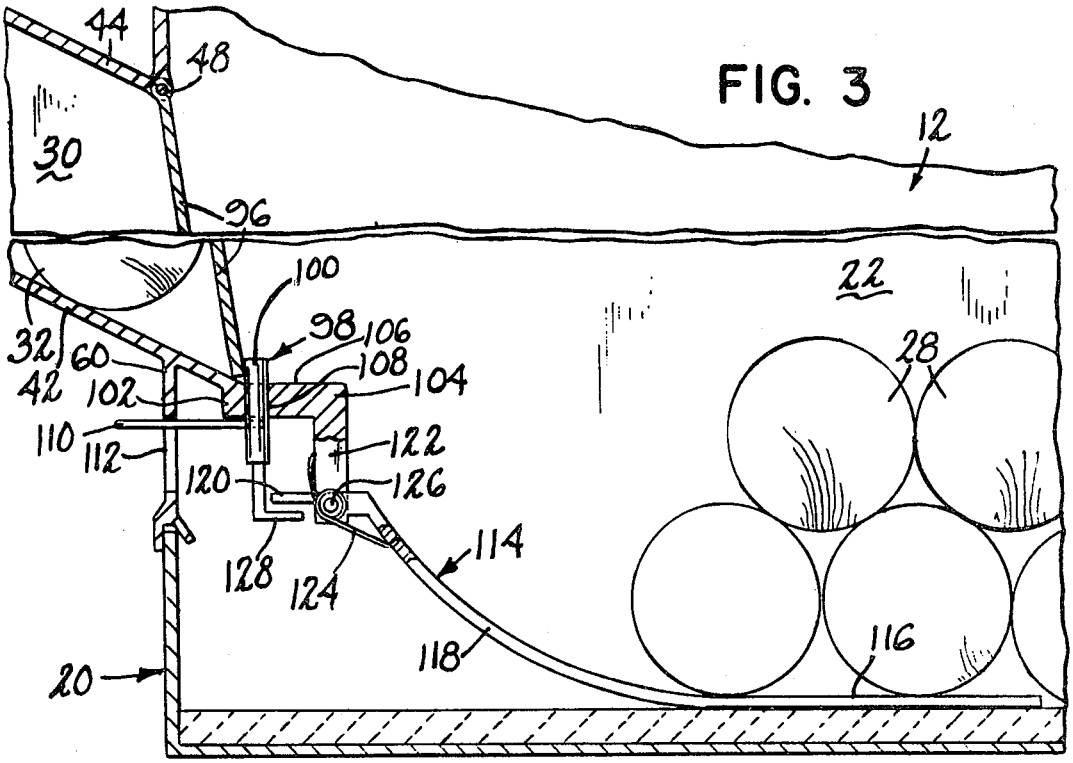
FIG. 3 is an elevational sectional side view of an alternate embodiment of the invention.

An alternate embodiment of catch assembly 40 and an alternate embodiment of sensor element 38 is shown in FIG. 3. For purposes of explanation, similar elements will be correspondingly numbered to FIGS. 1 and 2.

In the alternate embodiment of FIG. 3, door 96 is pivotally mounted to upper wall 44 by hinge element 48. Catch assembly 98 comprises a stop pin 100 slidably mounted in a generally vertical orientation at the inner edge 102 of lower wall 42. Brace 104 having a top surface 106 extends outwardly from inner edge 102 and contains bore 108 therethrough. Stop pin 100 is slidably mounted within bore 108 so as to be movable between at least first and second positions with the first position causing stop pin 100 to extend above top surface 106 to engage and maintain door 96 in the closed position in FIG. 3. In its second position, stop pin 100 is positioned below top surface 106 to release door 96. The frictional engagement of stop pin 100 in bore 108 suffices to maintain pin 100 in the first or engaging position upon the manual upward placement of pin 100 by locking arm 110. Locking arm 110 is connected to pin 100 and extends through vertical slot 112 in lower flange 60. Vertical slot 112 also functions as an air inlet for combustion chamber 22.

Sensor element 114 is a weight sensing element having a generally flat first or inner end portion 116, an arcuate middle portion 118, and a pivotally mounted second or outer end portion 120. End portion 120 is pivotally mounted to downwardly extending leg 122 of brace 104 about a horizontal axis 126. Biasing spring 124 is mounted about pivotal axis 126 and is connected at one end to arcuate portion 118 and at the other end to leg 122 to bias inner end 116 of sensor element 114 against the combusting wood fuel 28. End 120 of sensor 114 extends above actuating arm 128 of stop pin 100 as shown in FIG. 3.

In operation, locking arm 110 is moved vertically upward to stop or lock door 96 against the first or exit end portion of storage chamber 30. Wood fuel 32 is preferably of cylindrical shape and is loaded into storage chamber 30 with the downward inclination of lower wall 42 gravitating the wood against door 96. Biasing spring 124 biases end 116 of sensor 118 against the underside of combusting fuel 28 with the weight of the fuel counteracting the force of spring 124. End portion 116 may be in the form of a flat grate or a plate element in contact with the wood stove grate.

As the fuel 28 burns, it loses weight through combustion. Upon the weight of the fuel declining to a predetermined weight, i.e., a predetermined amount of fuel remains in combustion chamber 22, the biasing force of spring 124 pivots end portion 116 upwardly. The upward pivotal movement of end portion 116 causes outer end 120 to pivot downwardly into contact with actuating arm 128 and thus move stop pin 100 from a position engaging door 96 to a position disengaging door 96. Upon the release of door 96, gravity and the inclined orientation of the lower wall 42 will cause additional fuel 32 to tumble into the combustion chamber 22 and automatically stoke the fire. Sensor element 114 thus monitors the amount of fuel in combustion chamber 22 and senses a predetermined amount of fuel by sensing the weight of the predetermined amount.

While weight sensor 114 is shown in FIG. 3 in combination with catch assembly 98, catch assembly 98 can be used in combination with the height sensor 38 of FIG. 1 and weight sensor 114 can be used in combination with the catch assembly 40 of FIG. 1.

Figure 4:
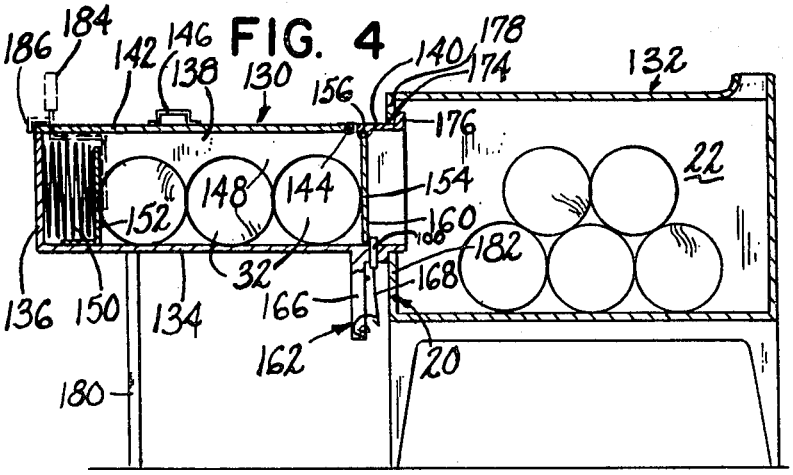
FIG. 4 is an elevated sectional side view of another alternate embodiment of the invention.
Figure 5:
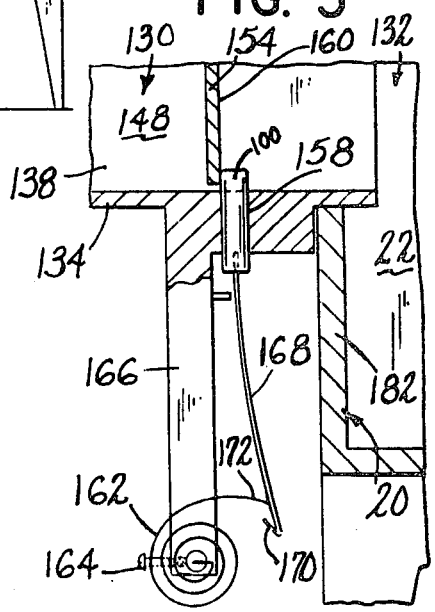
FIG. 5 is an enlarged partial view of FIG. 4.

A further alternate embodiment of the fuel feeder device is generally designated by the numeral 130 and is shown attached to wood stove 132 in FIG. 4. Fuel feeder 130 comprises a lower wall 134, end wall 136, opposing side walls 138 and top wall 140 having loading door 142 pivotally mounted thereto by hinge element 144. Door 142 is pivoted upwardly by handle 146 to allow access and loading of fuel into storage chamber 148.

Propulsion spring 150 is mounted within storage chamber 148 and is connected at one end to end wall 136 and at the other end to pusher element 152. At the exit or first end portion of storage chamber 148, chamber door 154 is pivotally mounted about a horizontal axis by hinge element 156 to upper wall 142.

Stop pin 100 is slidably mounted in a generally vertical disposition within bore 158 through lower wall 134. Stop pin 100 is slidably mounted for movement between first and second positions with the first position locating pin 100 into engagement with the outer surface 160 of chamber door 154 to maintain chamber door 154 in a closed position. The second position locates pin 100 so as to disengage and release door 154. The frictional engagement of pin 100 within bore 158 suffices to yieldably maintain pin 100 in the first position.

Heat sensor 162 is a bimetallic coil mounted by screw 164 to a brace 166 extending downwardly from lower wall 134. A metal connector strip 168 is connected at one end to stop pin 100 and has a retainer tab 170 at the other end. The actuating end 172 of bimetallic coil 162 is positioned adjacent retainer tab 170.

In operation, the outer or second end portion of fuel feeder 130 is inclined upwardly and the first or exit end portion is inserted into door opening 174 of front wall 20 so that upwardly extending flange 176 of top wall 140 clears the upper portion 178 of front wall 20. Once flange 176 is within combustion chamber 22, fuel feeder 130 is lowered to a generally horizontal position and is supported at one end by support leg 180 and at the other end by the lower portion 182 of front wall 20 engaging bottom wall 134. Fuel feeder 130 is then drawn away from stove 132 until flange 176 engages upper portion 178 in air-tight relationship. Asbestos rope may be utilized to ensure air-tight engagement.

Loading door 142 is pivoted upwardly to allow access to storage chamber 148 and a restraining handle 184 (shown in phantom line in FIG. 4) is placed in engagement with pusher 152. Handle 184 is then manually moved to compress propulsion spring 150 to the position shown in FIG. 4. Hook 186 temporarily secures handle 184 and spring 150 in this position while wood fuel 32 is loaded into chamber 148. Upon loading, hook 186 is released and restraining handle 184 is removed to allow propulsion spring 150 to strongly bias pusher element 152 against the additional wood fuel 32. The additional wood fuel 32 is in turn pushing against chamber door 154.

As the fire within combustion chamber burns down, less heat will be generated and the heat sensor, i.e., bimetallic coil 162 will begin to contract as it senses the reduction of heat. The contraction will cause actuating end 172 to engage retainer tab 170 thereby actuating or pulling stop pin 100 out of engagement with door 154. Upon the release of chamber door 154, propulsion spring 150 will propel or deliver the additional wood fuel 32 into the combustion chamber 22 to automatically stoke the fire. Thus, heat sensor 162 senses a predetermined amount of wood fuel in combustion chamber 22 by sensing a reduction in the amount of heat given off thereby.

The use of a horizontally disposed fuel storage chamber, together with a propulsion spring is preferred with wood stoves having a small door opening. A small door opening restricts the size of wood fuel that could be utilized with an inclined storage chamber and may be susceptible to clogging upon actuation. However, the use of a heat sensor 162 is not restricted to this configuration and, accordingly, a heat sensor could be utilized with the other embodiments of this invention. Furthermore, a propulsion spring may be utilized in combination with inclined lower wall 42 to deliver wood from the storage chamber to the combustion chamber. The degree of incline may be determined in relation to the force of the propulsion spring.

Thus, it can be seen that an automatic fuel feeder device for detachable securement to a wide variety of conventional wood stoves is disclosed. Each embodiment easily and quickly secures to the existing door opening of a wood stove and maintains the air-tight integrity of the wood stove for efficiency. No modifications to the existing wood stove are required although the firebox door may have to be removed prior to mounting on certain types of stoves. Otherwise, the fuel feeder is attachable without removal of the firebox door. Since the fuel feeder is completely detachable and removable, space and heating efficiency is maximized in that the size of the stove is determined by the particular heating application and does not have to be enlarged to accommodate the fuel feeder device. Thus, it can be seen that this device accomplishes at least all of its stated objectives.

While preferred and alternate embodiments of the apparatus of the invention have been described, the broad scope of the invention and alternatives, variations and modifications of the embodiments within the scope of the invention will be apparent to those skilled in the art and the appended claims are intended to encompass all alternatives, variations and modifications within the spirit and scope of the invention.

What I claim is:

1. A fuel feeder device for wood-burning stoves comprising:

a fuel storage chamber having first and second end portions, means for detachably mounting said storage chamber adjacent a wood stove so that said first end portion is aligned with the combustion chamber door opening of a wood stove, a door pivotally mounted adjacent said first end of said storage chamber, an elongated sensing member having first and second end portions with said first end portion adapted to extend into the combustion chamber of a wood stove to lie atop combusting fuel to sense the height thereof and said second end portion pivotally mounted adjacent said first end portion of said storage chamber, a catch means releasably connecting said second end portion of said sensing member to said storage chamber to release additional wood fuel upon said sensing means sensing a predetermined amount of combusting wood fuel with said second end portion of said sensing member being pivotally connected to said door, and means for delivering additional wood fuel from said storage chamber to the combustion chamber of a wood stove.

2. The device of claim 1 wherein said catch means comprises a hook element attached to said second end portion of said sensing member and a keeper element attached to said storage chamber, said keeper element adapted to releasably engage said hook element.

3. The device of claim 2 or 1 wherein:

said door has a slot therein with said sensing member extending through said slot, a pair of opposing, spaced apart, slotted guides are attached to said door, and a pair of guide pins are attached to said sensing member with each said guide pin slidably mounted in a respective slot of said guides.

4. A fuel feeder device for wood-burning stove comprising:

a fuel storage chamber having first and second end portions, means for detachably mounting said storage chamber adjacent a wood stove so that said first end porton is aligned with the combustion chamber door opening of a wood stove, means for sensing a predetermined amount of combusting wood fuel in the combustion chamber of a wood stove having an elongated sensing member having first and second end portions with said first end portion adapted to extend into the combustion chamber of a wood stove beneath the combusting fuel and said second end portion pivotally mounted adjacent said first end portion of said storage chamber with means for upwardly biasing said first end portion a predetermined amount, a door pivotally mounted adjacent said first end of said storage chamber, a catch means releasably engaging said door, having a stop element movably mounted adjacent said first end of said storage chamber between first and second positions, said stop element engaging said door in said first position to prevent pivotal movement of said door and removed from said door in said second position, and means for connecting said stop element to said sensing member so that upward pivotal movement of said first end portion of said sensing member moves said stop element from said first position to said second position to release additional wood fuel upon said sensing means sensing a predetermined amount of combusting wood fuel, and means for delivering additional wood fuel from said storage chamber to the combustion chamber of a wood stove.

5. A fuel feeder device for wood-burning stoves comprising:

a fuel storage chamber having first and second end portions, means for detachably mounting said storage chamber adjacent a wood stove so that said first end portion is aligned with the combustion chamber door opening of a wood stove, means for sensing a predetermined amount of combusting wood fuel in the combustion chamber of a wood stove, a door pivotally mounted adjacent said first end portion of said fuel storage chamber to alternatively contain additional wood fuel in said storage chamber and release wood fuel from said storage chamber, and actuable catch means releasably engaging said door means, said catch means having a stop element movably mounted adjacent said first end of said storage chamber between first and second positions, said stop element engaging said door in said first position to prevent pivotal movement of said door and removed from said door in said second position, said stop element being connected to said sensing means to release additional wood fuel upon said sensing means sensing a predetermined amount of combusting wood fuel, and means for delivering additional wood fuel from said storage chamber to the combustion chamber of a wood stove.

6. A fuel feeder device for wood-burning stoves comprising:

a fuel storage chamber having first and second end portions and a frame extending about the outer periphery of said storage chamber, means for detachably mounting said storage chamber adjacent a wood stove so that said first end portion is aligned with the combustion chamber door opening of a wood stove, means for sealing said frame to the door opening of a wood stove in air-tight relationship being attached to said frame, actuable means for releasably maintaining additional wood fuel in said storage chamber, said maintaining means being connected to said storage chamber and having a door pivotally mounted adjacent said first end portion of said storage chamber and a catch means releasably engaging said door, means for sensing a predetermined amount of combusting wood fuel in the combustion chamber of a wood stove, said sensing means being connected to said maintaining means to actuate said maintaining means to release additional wood fuel upon said sensing means sensing a predetermined amount of combusting wood fuel, and means for delivering additional wood fuel from said storage chamber to the combustion chamber of a wood stove.

7. The device of claim 5 or 6 wherein said sensing means comprises a sensing member adapted to protrude into the combustion chamber of a wood stove to sense the amount of combusting fuel and being pivotally mounted adjacent said first end portion of said storage chamber.

8. The device of claim 5 or 6 wherein said sensing means comprises an elongated sensing member having first and second end portions with said first end portion adapted to extend into the combustion chamber of a wood stove to lie atop combusting fuel to sense the height thereof and said second end portion pivotally mounted adjacent said first end portion of said storage chamber.

9. The device of claim 8 wherein said first end portion is arcuate shaped.

10. The device of claim 5 or 6 wherein:

said sensing means comprises an elongated sensing member having first and second end portions with said first end portion adapted to extend into the combustion chamber of a wood stove beneath the combusting fuel and said second end portion pivotally mounted adjacent said first end portion of said storage chamber, and means for upwardly biasing said first end portion a predetermined amount.

11. The device of claim 5 or 6 wherein said sensing means comprises a means for sensing heat.

12. The device of claim 5 or 6 wherein:

said sensing means comprises means for sensing a predetermined amount of heat and being connected to said catch means.

13. The device of claim 12 wherein said means for sensing a predetermined amount of heat is a bimetallic coil, said coil being connected to said catch means.

14. The device of claim 5 or 6 wherein said means for delivering comprises:

said storage chamber having a bottom fuel supporting surface with first and second end portions and said support surface being inclined downwardly from said second end portion to said first end portion to gravitationally drive additional wood fuel within said storage chamber toward said first end portion.

15. The device of claim 5 or 6 wherein said means for delivering comprises:

a pusher element movably mounted within said fuel storage chamber between said first and second end portions of said storage chamber, and means for biasing said pusher element toward said first end portion.

16. The device of claim 15 wherein:

said means for biasing comprises a spring attached to said second end portion, and said pusher element is slidably mounted within said fuel storage chamber.

17. The device of claim 5 or 6 wherein said storage chamber comprises at least one support leg.

18. The device of claim 6 wherein, said frame comprises an upper flange portion and a lower flange portion, said lower flange portion having a furcated edge adapted to supportively engage the lower edge of the combustion chamber door opening of a wood stove in air-tight engagement and a dog clamp means is mounted to said upper flange for clamping said frame in air-tight engagement to the door opening of a wood stove.

19. The device of claim 18 wherein asbestos rope is connected to said frame so as to be disposed between said frame and a wood stove when said chamber is mounted to a wood stove.

20. The device of claim 6 wherein, said chamber has a loading door operable between an open and a closed position, said loading door being disposed at said second end portion of said chamber in air-tight engagement with said chamber in a closed position and said sensing means and said maintaining means are contained within said chamber and the combustion chamber of a wood stove when said chamber is mounted to a wood stove to maintain the air-tight integrity of the wood stove.

21. A fuel feeder device for wood-burning stoves comprising:

a fuel storage chamber having first and second end portions, means for detachably mounting said storage chamber adjacent a wood stove so that said first end portion is aligned with the combustion chamber door opening of a wood stove, a door pivotally mounted adjacent said first end portion of said fuel storage chamber to alternatively contain additional wood fuel in said storage chamber and release wood fuel from said storage chamber, actuable catch means releasably engaging said door having a hook element connected to said door and a corresponding keeper element connected to said storage chamber, means for sensing a predetermined amount of combusting wood fuel in the combustion chamber of a wood stove, said sensing means being connected to said catch means to release said door and additional wood fuel upon said sensing means sensing a predetermined amount of combusting wood fuel, and means for delivering additional wood fuel from said storage chamber to the combustion chamber of a wood stove.

22. In combination with a space heating stove having outer walls enclosing a combustion chamber and an access doorway to said combustion chamber for manual fuel loading, a fuel feeder device comprising, a fuel storage chamber to hold additional fuel having an end portion for detachable mounting to said doorway, means for releasably mounting said storage chamber to said doorway, actuable means for holding fuel within said storage chamber and releasing fuel upon actuation, said holding means having a door pivotably mounted to said end portion of the storage chamber and actuable catch means to hold said door in a closed position to hold fuel within said storage chamber and upon actuation to release said door to allow additional fuel to move to said combustion chamber, means for sensing a predetermined amount of combusting fuel in said combustion chamber, said sensing means being connected to said holding means to actuate said means to release fuel upon sensing a predetermined amount of fuel, and means for moving additional fuel from said storage chamber to said combustion chamber upon actuation of said holding means.

23. The combination of claim 22 wherein:

said sensing means comprises an elongated sensing member pivotally mounted to said door and extending into said combustion chamber to sense combusting fuel, said catch means comprises a hook element connected to said sensing means and a keeper element connected to said storage chamber, said hook element engaging said keeper element to hold said door in a closed position and disengaging said keeper element upon pivotal rotation of said sensing member in sensing a predetermined amount of combusting fuel.

24. The combination of claim 23 wherein:

said elongated sensing member has first and second end portions, said first end portion lying atop combusting fuel and said hook element being attached to said second end portion, said door has a slot therein with said second end portion of said sensing member extending through said slot, a pair of spaced-apart slotted guides are attached to said door adjacent said slot, and a pair of guide pins are attached to said second end portion of said sensing member and are slidably mounted within said guides whereby downward movement of said first end portion upon the burning away of a predetermined height of fuel pivots said second end portion to disengage said hook from said keeper.

25. The combination of claim 23 wherein:

said catch means comprises a stop element movably mounted adjacent said door for movement between first and second positions, said stop element in said first position engaging said door to hold said door in a closed position and removed from said door in said second position to allow pivotal movement of said door, and said sensing means being connected to said catch means to move said stop element to said second position upon sensing a predetermined amount of combusting fuel.

26. The combinationn of claim 22 wherein said sensing means is a means for sensing heat.

27. The combination of claim 26 wherein said means for sensing heat is a bimetallic coil.

28. The combination of claim 22 wherein said sensing means is a means for sensing height of fuel within said combustion chamber.

29. The combination of claim 22 wherein said sensing means is a weight sensing means.

30. The combination of claim 29 wherein said weight sensing means comprises:

an elongated sensing element having a first end extending into said combustion chamber so combusting fuel lies atop said first end, said sensing element being pivotally mounted to said storage chamber, means for upwardly biasing said first end portion of said sensing element a predetermined amount, and the second end of said sensing element being connected to said holding means so that pivotal movement of said second end upon the combusting of a predetermined amount of fuel actuates said holding means.

31. The combination of claim 22 wherein:

said storage chamber has a bottom wall for supporting fuel, and said means for moving additional fuel comprises said bottom wall being inclined downwardly toward said combustion chamber whereby the force of gravity moves additional fuel into said combustion chamber.

32. The combination of claim 22 wherein said means for moving additional fuel is a pusher element movably mounted within said storage chamber and biased toward said combustion chamber.

33. The combination of claim 22 wherein:

said end portion of said storage chamber has a flange in engagement with said doorway, and said mounting means comprises a means for clamping said flange to said stove.

34. The combination of claim 22 wherein:

a frame extends about the outer periphery of said storage chamber and means for sealing said frame to said doorway in an airtight relationship is attached to said frame.

* * * * *